US010371478B2

(12) United States Patent
Sexton

(10) Patent No.: US 10,371,478 B2
(45) Date of Patent: Aug. 6, 2019

(54) BENCH BLOCK TO AID IN DISASSEMBLING AND CLEANING A HANDGUN AND METHODS OF MAKING AND USING SAME

(71) Applicant: Kimberley Beadie Sexton, Katy, TX (US)

(72) Inventor: Kimberley Beadie Sexton, Katy, TX (US)

( * ) Notice: Subject to any disclaimer, the term of this patent is extended or adjusted under 35 U.S.C. 154(b) by 303 days.

(21) Appl. No.: 15/275,615

(22) Filed: Sep. 26, 2016

(65) Prior Publication Data

US 2018/0087863 A1 Mar. 29, 2018

(51) Int. Cl.

| | |
|---|---|
| ***F41A 23/18*** | (2006.01) |
| ***F41A 29/00*** | (2006.01) |
| ***F41A 11/00*** | (2006.01) |

(52) U.S. Cl.

CPC ..... *F41A 23/18* (2013.01); *F41A 11/00* (2013.01); *F41A 29/00* (2013.01)

(58) Field of Classification Search

None

See application file for complete search history.

(56) References Cited

U.S. PATENT DOCUMENTS

| | | | |
|---|---|---|---|
| 7,100,000 | B1 | 8/2006 | Ittycheriah et al. |
| 7,240,450 | B2 | 7/2007 | Shober |
| 7,401,432 | B2 | 7/2008 | Perry |
| 7,726,478 | B2 | 6/2010 | Potterfield et al. |
| 7,946,071 | B2 | 5/2011 | Cauley |
| 8,296,988 | B2 | 10/2012 | Yale et al. |
| 8,327,570 | B2 | 12/2012 | Potterfield et al. |
| 8,371,057 | B2 | 2/2013 | Coffield, III et al. |
| 8,393,106 | B2 | 3/2013 | Cauley et al. |
| 8,464,628 | B2 | 6/2013 | Potterfield et al. |
| 8,484,878 | B2 | 7/2013 | Borkowski |
| 8,490,311 | B2 | 7/2013 | Hogue |
| 8,496,072 | B2 | 7/2013 | White |
| 8,505,433 | B2 | 8/2013 | Hochstrate et al. |
| 8,516,734 | B2 | 8/2013 | Yale et al. |
| 8,567,106 | B2 | 10/2013 | Chvala |
| 8,578,645 | B2 | 11/2013 | Cauley |
| 8,590,440 | B2 | 11/2013 | Gallo |
| 8,595,970 | B2 | 12/2013 | Picciotta et al. |
| 8,615,915 | B2 | 12/2013 | Hunter et al. |
| 8,621,773 | B2 | 1/2014 | Morrow et al. |
| 8,640,375 | B2 | 2/2014 | Ketchum |
| 8,651,289 | B2 | 2/2014 | Diaz, Jr. et al. |

(Continued)

OTHER PUBLICATIONS

Compartment Definition, found at https://www.merriam-webster.com/dictionary/compartment, Sep. 2018, attached as pdf.*

*Primary Examiner* — Joseph J Hail
*Assistant Examiner* — Brian D Keller
(74) *Attorney, Agent, or Firm* — Robert W. Strozier

(57) ABSTRACT

Apparatuses for hand firearm maintenance and cleaning including a body and a magazine swivel assembly, where the body includes a slide receiving area including a reciprocating member designed to engage a firing pin assembly of a hand firearm or handgun and at least one circular recess or receptacle adapted to receive the swivel assembly, where the swivel assembly is adapted to receive a handgun magazine or the handgun with a magazine inserted therein and for methods of making and using same.

11 Claims, 13 Drawing Sheets

(56) References Cited

U.S. PATENT DOCUMENTS 8,657,127 B2 2/2014 Diaz, Jr. et al.
8,661,723 B2 3/2014 Emde et al.
8,677,879 B1 3/2014 Gresham et al.
8,707,604 B2 4/2014 Troy et al.
8,739,453 B1 6/2014 Conner et al.
8,739,982 B2 6/2014 Werner
8,752,322 B2 6/2014 Kresser et al.
8,763,295 B2 7/2014 Trimble
8,783,160 B2 7/2014 Hochstrate et al.
8,806,793 B2 8/2014 Daniel et al.
8,813,407 B1 8/2014 Sargent et al.
8,819,981 B2 9/2014 Malik et al.
8,819,984 B2 9/2014 Borkowski et al.
8,832,985 B2 9/2014 Smith, III
8,839,544 B2 9/2014 Troy et al.
8,857,093 B2 10/2014 Hogue
8,857,094 B2 10/2014 Michel
8,857,096 B2 10/2014 McClintock et al.
8,869,444 B2 10/2014 Bosco et al.
8,887,432 B2 11/2014 Oz et al.
8,904,693 B1 12/2014 Beltz
8,910,407 B2 12/2014 Singh
8,931,193 B1 1/2015 Bogart et al.
8,943,729 B2 2/2015 Williams
8,943,947 B2 2/2015 Gomez et al.
8,959,820 B2 2/2015 Larson, Jr.
8,973,297 B2 3/2015 Boggess et al.
9,010,008 B2 4/2015 Hovey et al.
9,015,980 B2 4/2015 Shull
9,021,728 B1 5/2015 Kocmich, IV et al.
9,027,274 B2 5/2015 Pientka
9,151,561 B2 10/2015 Morrow et al.
9,328,983 B2 5/2016 Wilkinson
2002/0040544 A1 4/2002 Muhlestein
2002/0078617 A1 6/2002 Percival
2003/0089017 A1 5/2003 Roush
2003/0140543 A1 7/2003 Yeargin
2004/0144010 A1 7/2004 Golan
2004/0244254 A1 12/2004 Barfield
2005/0108915 A1 5/2005 Kincel
2005/0183317 A1 8/2005 Finn
2005/0183319 A1 8/2005 Franks
2005/0188587 A1 9/2005 Danas
2005/0188595 A1 9/2005 Lackey
2005/0188597 A1 9/2005 Keng
2005/0229466 A1 10/2005 Muhlestein
2005/0241206 A1 11/2005 Teetzel
2005/0246935 A1 11/2005 Northrup
2006/0162222 A1 7/2006 Beretta
2006/0218840 A1 10/2006 Cauley
2006/0248775 A1 11/2006 Wade
2006/0254111 A1 11/2006 Giauque
2007/0074440 A2 4/2007 Cauley
2007/0137087 A1 6/2007 Florea et al.
2007/0199224 A1 8/2007 Bentley
2007/0261287 A1 11/2007 Hunt
2007/0294929 A1 12/2007 Potterfield et al.
2008/0034636 A1 2/2008 Potterfield et al.
2008/0052979 A1 3/2008 Lee et al.
2008/0127815 A1* 6/2008 Yale ..... F41A 23/18 89/37.01
2008/0172919 A1 7/2008 Lackey
2008/0263928 A1 10/2008 Potterfield
2009/0000175 A1 1/2009 Potterfield et al.
2009/0025267 A1 1/2009 Reinert et al.
2009/0038199 A1 2/2009 Oz
2009/0049731 A1 2/2009 Seuk
2009/0056192 A1 3/2009 Oz
2009/0183415 A1 7/2009 Boord
2009/0193702 A1 8/2009 Lin
2009/0205238 A1 8/2009 Willis, Jr.
2009/0249674 A1 10/2009 Boord
2009/0249675 A1 10/2009 Cauley
2010/0126055 A1 5/2010 Potterfield
2010/0154272 A1 6/2010 Lamm
2010/0236126 A1 9/2010 Johnson
2010/0242332 A1 9/2010 Teetzel et al.
2010/0242335 A1 9/2010 Duval
2010/0270201 A1 10/2010 Cauley
2011/0061283 A1 3/2011 Cavallo et al.
2011/0079524 A1 4/2011 Potterfield et al.
2011/0107643 A1 5/2011 Fitzpatrick et al.
2011/0131861 A1 6/2011 Seuk
2011/0167698 A1 7/2011 Hoguc
2011/0192070 A1 8/2011 Boord
2011/0247256 A1 10/2011 Lickteig
2012/0005937 A1 1/2012 Milino
2012/0011760 A1 1/2012 Cauley
2012/0085012 A1 4/2012 Potterfield et al.
2012/0102806 A1 5/2012 Potterfield et al.
2012/0186126 A1 7/2012 Bartak
2012/0246991 A1 10/2012 Seuk
2012/0285064 A1 11/2012 Houde-Walter
2012/0291330 A1 11/2012 Johnson
2013/0000174 A1 1/2013 Troy
2013/0025178 A1 1/2013 Blitch
2013/0036647 A1 2/2013 Chvala
2013/0061564 A1 3/2013 Yale et al.
2013/0097910 A1 4/2013 Daniel et al.
2013/0167424 A1 7/2013 Nail et al.
2013/0205636 A1 8/2013 Shull
2013/0212921 A1 8/2013 McDonald
2013/0333263 A1 12/2013 Hovey
2014/0047753 A1 2/2014 Grossman et al.
2014/0075814 A1 3/2014 Larson et al.
2014/0115939 A1 5/2014 Troy et al.
2014/0304898 A1 10/2014 Bachtold
2014/0373419 A1 12/2014 Leclair
2015/0000007 A1 1/2015 Gleason et al.
2015/0007375 A1 1/2015 Lee-Holowka et al.
2015/0040457 A1 2/2015 Borkowski et al.
2015/0121737 A1 5/2015 Anderson et al.
2015/0121741 A1 5/2015 Bowman
2015/0135409 A1 5/2015 Mongan et al.
2015/0167725 A1 6/2015 Lee
2015/0247698 A1 6/2015 Bosco
2015/0198408 A1 7/2015 Kincel et al.
2015/0216731 A1 8/2015 Bouza et al.
2015/0226524 A1 8/2015 Batchvarov
2015/0241160 A1 8/2015 McGinty
2015/0285577 A1 10/2015 Faifer
2015/0285583 A1 10/2015 Mayberry et al.
2015/0300774 A1 10/2015 Wheaton
2015/0300775 A1 10/2015 Combs
2015/0336021 A1 11/2015 McCary, Sr.
2016/0003571 A1 1/2016 Kleinfelder
2016/0069632 A1 3/2016 Williams et al.
2016/0076847 A1 3/2016 Franklin
2016/0084603 A1 3/2016 Michal et al.
2016/0097610 A1 4/2016 Hancosky
2016/0153742 A1 6/2016 Copeland et al.
2016/0178315 A9 6/2016 Bosco

* cited by examiner

FIG. 3
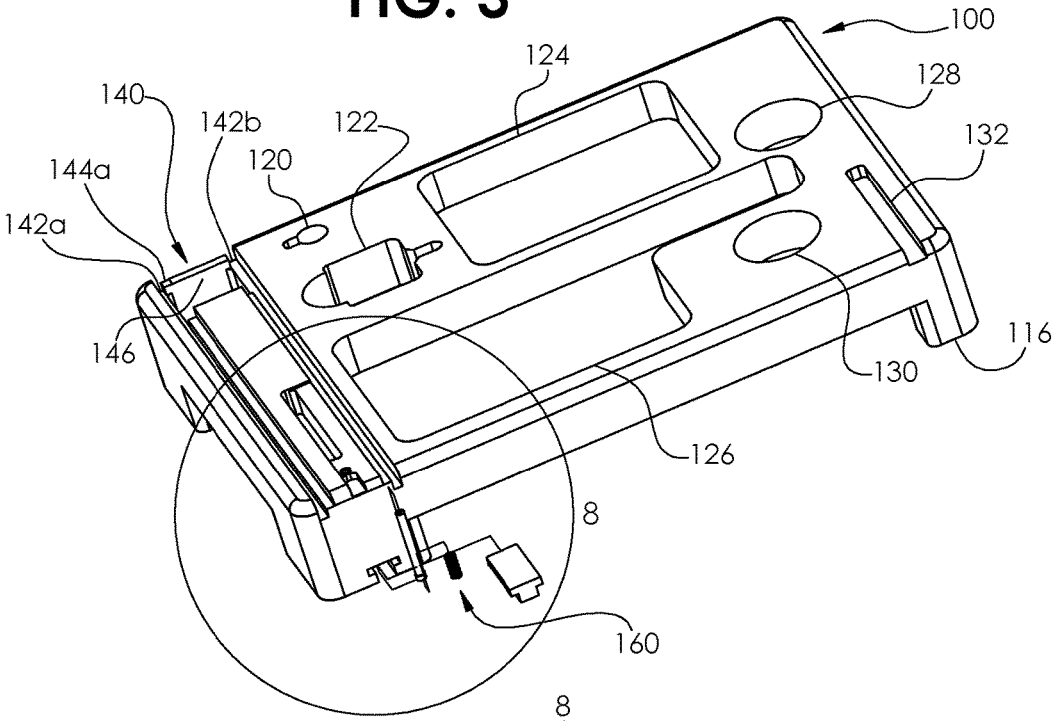
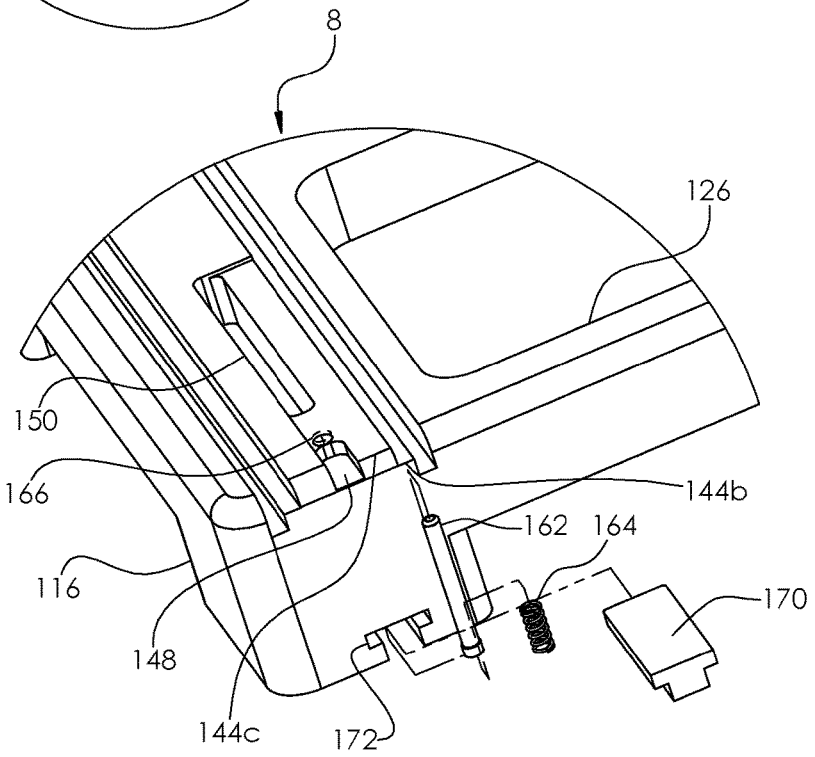
FIG. 4

BENCH BLOCK TO AID IN DISASSEMBLING AND CLEANING A HANDGUN AND METHODS OF MAKING AND USING SAME

BACKGROUND OF THE INVENTION

1. Field of the Invention

Embodiments of the present disclosure relates to apparatuses for semi-automatic firearm maintenance and cleaning and for methods of making and using same.

More particularly, embodiments of the present disclosure relates to apparatuses for hand firearm maintenance and cleaning and for methods of making and using same, where the apparatuses include a body and a magazine swivel assembly, where the body includes a slide receiving area including a reciprocating member designed to engage a safety of a handheld firearm or handgun and at least one circular recess or receptacle adapted to receive the swivel assembly, where the swivel assembly is adapted to receive a handgun magazine or the handgun with a magazine inserted thereon.

2. Description of the Related Art

Traditionally, a firearm such as a semi-automatic pistol are handheld or held by a vise, or other clamping type devises, for maintenance and cleaning. However, holding the firearm manually or by other holding type devises not designed for holding firearms, for maintenance and cleaning without a supporting device designed for firearms may, for example, result in damage the receiver, or the finish of the firearm thereof, during maintenance, disassembly and reassembly.

Supporting devices for firearms are generally either cylindrical or rectangular in design. These types of prior art devises commonly support in part or fully the firearm receiver, in a horizontal position and are mainly to support the firearm receiver for pin removal and installation. Other characteristics may include a striker holder, vertical slide holder, and a magazine mount and swivel.

Firearm holding devises found in the prior art commonly holds the handgun in either a vertical plane or by placing the firearm in the horizontal plane position, i.e. either in the firing position or the muzzle pointing downwards in the vertical position.

Adjustable devises found in the prior art, hold the firearm receiver in the horizontal position, and restrict or prevent the disassembly thereof, when held in place by the devise.

While numerous handgun cleaning support devices have been disclosed and described in the prior art, they all have certain advantages and disadvantages. Thus, it would be beneficial to have a simple to use handgun support apparatus for assisting in handgun maintenance and cleaning.

SUMMARY OF THE INVENTION

Embodiments of this disclosure provide a firearm cleaning bench block apparatus including: (a) a bench block base or body including (i) at least one magazine holder and swivel receptacle and (ii) a slide receiving area comprising: (1) two outer rails, (2) three inner rails, (3) a rectangular channel for subcompact slides, (4) a slide ramp channel, (5) a firing pin lug face stop channel, (6) a retention rod, (7) a cylindrical vertical housing adapted to receive the retention rod, (8) a retention rod spring, (9) a cylindrical vertical housing adapted to receive the retention rod spring, (10) a retention rod mechanism floor plate, and (11) a floor plate channel adapted to receive the retention rod mechanism floor plate and (b) a magazine holder and swivel. The body may also include a top face configured to support a firearm, at least one slide receptacle adapted to receive a slide in a vertical orientation, a firing pin assembly receptacle adapted to receive a firing pin assembly, a plurality of legs, a plurality of non-slip pads, and/or a plurality of legs having non-slip pads, at least one parts compartment, a second cylindrical compartment, and a tool slot adapted to receive a pin punch tool. The body may be made of a non-marring thermoplastic material, a metal material, a composite material, wood, or combinations thereof.

Embodiments of this disclosure provide methods for maintenance and cleaning a semi-automatic firearm, where the methods include the steps of removing a side from the firearm, placing the slide vertically in the vertical slide receptacle and removing a recoil spring assembly and a barrel from the slide. The methods also include placing the slide horizontally in the slide receiving area, moving the slide to the left and right until the reciprocating rod pushes upward into a gap formed between a firing pin's lug face and the inner backside of a firing pin spacer sleeve of the slide, and removing a slide cover plate, an extractor depressor plunger assembly, an extractor, a firing pin assembly, a firing pin safety and firing pin safety spring. The methods also include placing a receiver of the pistol on the body and removing a locking block pin, a trigger pin, and a trigger housing pin from the receiver. The methods also include sliding the receiver with the magazine into the magazine receiving slot of the swivel assembly and removing a slide stop lever, a locking block, a trigger mechanism with ejector, slide lock, and slide lock spring. The methods also include placing the firing pin assembly in the firing pin assembly receptacle, and removing firing pin spring cups, a firing spring, a firing pin spacer sleeve, and a firing pin.

BRIEF DESCRIPTION OF THE DRAWINGS

The disclosure can be better understood with reference to the following detailed description together with the appended illustrative drawings in which like elements are numbered the same:

FIG. 3 depicts an alternate view of the bench block of FIG. 1.

FIG. 4 depicts an exploded view of the retention rod mechanism and floor plate in accordance with an embodiment of the present disclosure of FIG. 1.

Figure 1:
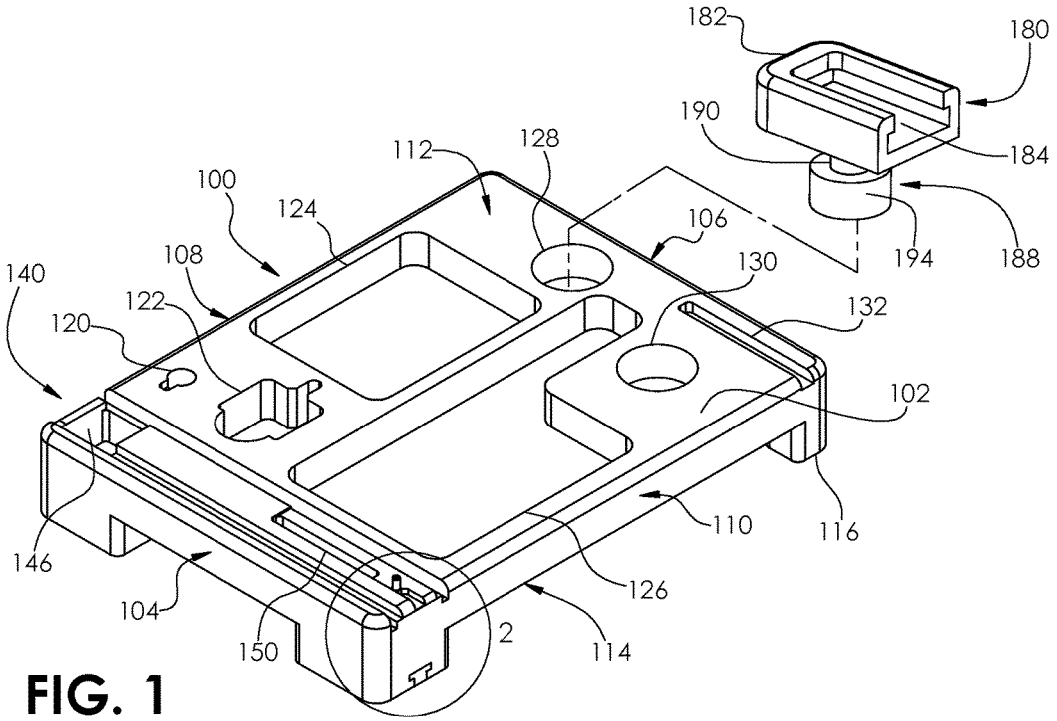
FIG. 1 depicts a perspective view of an embodiment of a bench block of the present disclosure.
Figure 2:
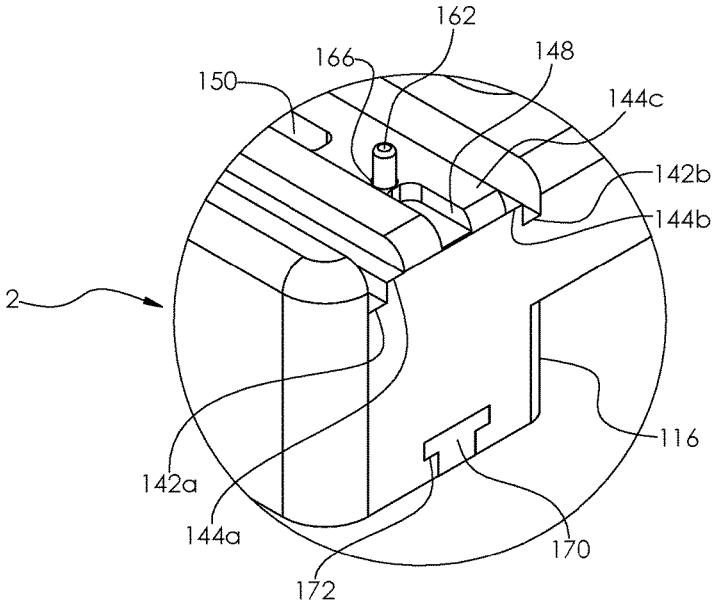
FIG. 2 depicts an enlarged section view of the bench block of FIG. 1.

Corresponding reference characters indicate corresponding components throughout the several views of drawings. Skilled artisans will applicate that the elements in the figures are illustrated for simplicity and clarity and have not necessarily been drawn to scale. For example, some of the other elements in the figures may be exaggerated of various embodiments of the present disclosure. Also, common but well understood elements that are useful of necessary in a commercially feasible embodiment are often not depicted in order to facilitate a less obstructed view of these various embodiments of the present disclosure.

DETAILED DESCRIPTION OF THE INVENTION

The inventor has found that apparatuses may be constructed to aid in firearm disassembly, cleaning, and reassembly, where the apparatuses include a body and a swivel assembly. The body includes a firing pin assembly receptacle, a vertical slide receptacle, a first cylindrical receptacle, a horizontal slide receiving area including a reciprocating retention rod, where the area is adapted to receive a slide of a firearm so that a gap is formed between a firing pin's lug face and the inner backside of a firing pin spacer sleeve of a slide of a firearm allowing the retention rod to move upwards into the gap. The swivel assembly includes a swivel body including: a magazine receiving slot and a shaft, and a cylindrical support member including: a cylindrical shaft channel adapted to receive the shaft so that the swivel assembly is rotatable about the shaft by 360°, where the member is adapted to fit into the first cylindrical receptacle. In certain embodiments, the support member further includes a narrow top portion including the cylindrical shaft channel, and a broader bottom portion adapted to fit into either the first or second cylindrical receptacle. In other embodiments, the horizontal slide receiving area further includes a retention rod assembly including the retention rod, a retention rod spring, a cylindrical rod guide channel, a cylindrical rod spring channel, a retention rod floor plate, and a retention rod floor plate channel. In other embodiments, the horizontal slide receiving area further includes a first outer rail, a second outer rail, a first inner rail, second inner rail, a third inner rail, a subcompact slide channel, a firing pin lug face stop channel, and a slide ramp channel. In other embodiments, the body further includes a plurality of non-slip pads disposed on the bottom surface of the body. In other embodiments, the body further includes a plurality of legs. In other embodiments, the body further includes a plurality of non-slip pads disposed on the bottom surface of each leg. In other embodiments, the body further includes a second cylindrical receptacle, a small parts compartment, and a large parts compartment. In other embodiments, the body further includes a pin punch tool holder.

The inventor has also found that a non-marring rectangular thermoplastic bench block apparatus may be constructed in a simple, safe and stable configuration having few removable components reducing maintenance and repair problems. Additionally, the removable components may be inexpensively replaced if damaged. The apparatus and components may be produced and assembled inexpensively to provide comfort and functionality to the user. The apparatus is of lightweight, non-marring, durable bench block construction adapted to facilitate the maintenance and cleaning of semi-automatic firearms providing and is easily transported to the users work bench or table top.

The bench block apparatus is a generally horizontal rectangular base having a top and a bottom surfaces and a separate magazine receive swivel assembly. The base includes at least one cylindrical recess or receptacle and a slide rail receiving area for horizontal placement of a slide assembly of a handgun. The slide rail receiving area includes a retention rod mechanism including a retention rod, a retention rod spring and a retention rod mechanism floor plate, where the retention rod is adapted to engage the firing pin assembly of the slide assembly of the handgun. The slide rail receiving area also includes channels and slots conforming to the bottom of the slide assembly holding the slide assembly in place for easy disassembly. The base may also include a tool holder compartment, parts compartments, a slide receptacle for vertical slide placement, and a firing pin assembly receptacle for vertical firing pin assembly placement. The base may also include a plurality of legs having non-slip pads on their bottom surface or a plurality of non-slip pads, strips, or surfaces on the bottom of the apparatus.

Embodiments of this disclosure broadly relate to bench block apparatuses including a body having a firing pin assembly receptacle, a vertical slide receptacle, a first cylindrical receptacle, a horizontal slide receiving area including a reciprocating retention rod assembly having a retention rod, where the area is adapted to receive a slide of a firearm so that a gap is formed between a firing pin's lug face and an inner backside of a firing pin spacer sleeve of the slide allowing the retention rod to move upwards into the gap. The apparatuses also include a swivel assembly having a swivel body including a magazine receiving slot, and a shaft, and a support member including a shaft receiving channel adapted to receive the shaft so that the swivel assembly is rotatable about the shaft by 360°, where the support member is adapted to fit into the first cylindrical receptacle. In certain embodiments, the support member further includes a narrow top portion including the shaft receiving channel, and a broader bottom portion adapted to fit into either the first cylindrical receptacle. In other embodiments, the reciprocating retention rod assembly further includes the retention rod, a retention rod reciprocating member, a retention rod glide channel, and a rod spring channel, where the retention rod reciprocating member allows the retention rod to move up and down depending on a force applied to a top of the retention rod and where the retention rod reciprocating member comprises a spring, a resilient and restorative member, or a combination thereof. In other embodiments, the reciprocating retention rod assembly further includes a retention rod floor plate, and a retention rod floor plate channel, where the retention rod floor plate holds the retention rod reciprocating member and the retention rod in place. In other embodiments, the horizontal slide receiving area further includes a first outer rail, a second outer rail, a first inner rail, a second inner rail, a third inner rail, a compact slide channel, a firing pin lug face stop channel, and a slide ramp channel, where the rails and the channels are adapted to conform to a bottom structure of the slide so that the retention rod is positioned to move upward into the gap facilitating the removal of a slide cover plate of the firearm. In other embodiments, the body further includes a plurality of non-slip pads disposed on a bottom surface of the body, or a plurality of legs including non-slip pads disposed on a bottom surface of each leg. In other embodiments, the body further includes a second cylindrical receptacle, and at least one parts compartment, where the second cylindrical receptacle is adapted to receive the swivel assembly or components from the firearm during disassembly, and where the at least one parts compartment is adapted to receive components of the firearm during disassembly. In other embodiments, the body further includes a small parts compartment, a large parts compartment, where the compartments are adapted to receive components of the firearm during disassembly, and a pin punch tool holder.

Embodiments of this disclosure broadly relate to bench block apparatuses including a body including a firing pin assembly receptacle, a vertical slide receptacle, a first cylindrical receptacle, a horizontal slide receiving area including a first outer rail, a second outer rail, a first inner rail, a second inner rail, a third inner rail, a subcompact slide channel, a firing pin lug face stop channel, and a slide ramp channel, a reciprocating retention rod assembly comprising a retention rod, a retention rod reciprocating member comprising a spring, a resilient and restorative member, or a combination thereof, a retention rod glide channel, a retention rod reciprocating member channel, a retention rod floor plate, and a retention rod floor plate channel, where the retention rod reciprocating member allows the retention rod to move up and down depending on a force applied to a top of the retention rod, where the retention rod floor plate holds the retention rod reciprocating member and the retention rod in place, where the rails and the channels are adapted to conform to a bottom structure of the slide so that the retention rod is positioned to move upward into a gap formed between a firing pin's lug face and an inner backside of a firing pin spacer sleeve of the slide facilitating the removal of a slide cover plate of the firearm, and a swivel assembly including a swivel body including a magazine receiving slot, and a shaft, and a support member including a narrow top portion including a shaft receiving channel adapted to receive the shaft so that the swivel assembly is rotatable about the shaft by 360°, and a broader bottom portion adapted to fit into either the first cylindrical receptacle. In certain embodiments, the body further includes a plurality of non-slip pads disposed on a bottom surface of the body, or a plurality of legs including non-slip pads disposed on a bottom surface of each leg, or a second cylindrical receptacle, or at least one parts compartment, or any combination thereof, where the second cylindrical receptacle is adapted to receive the swivel assembly or components from the firearm during disassembly, and the at least one parts compartment is adapted to receive components of the firearm during disassembly. In other embodiments, the body further includes a small parts compartment, a large parts compartment, where the compartments are adapted to receive components of the firearm during disassembly, and a pin punch tool holder.

The apparatuses of this disclosure are designed to permit easy disassembly, cleaning and reassembly of hand held firearms such as semi-automatic pistol made by manufactures such as GLOCK, Inc. and Smith & Wesson, or other manufactures of slide semi-automatic handguns having a slide configured similar to the GLOCK and Smith & Wesson M&P semi-automatic handguns for military, law enforcement, enthusiast, sports, and personal defense. Most manufacturers make handguns of different sizes. For example, GLOCK makes standard, compact, subcompact, and competition type semi-automatic pistols having different caliber ammunition.

The GLOCK semi-automatic handguns employ the principle of using recoil from expanding combustion gases from a cartridge to force a slide and barrel rearward relative to the receiver handgrip and against a return biasing force of a recoil-spring assembly acting on the slide. Once the slide has been propelled rearward and the spent cartridge casing ejected from the firing chamber via a combined action of both an ejector and an extractor, the slide is propelled in a forward direction by the recoil-spring assembly so as to strip the next cartridge from a magazine contained in a magazine well in the receiver handgrip and feed the next cartridge into the firing chamber. The recoil spring assembly returns the slide to the full forward position where it locks the barrel and readies for the next firing. Consequently, it is understood that the recoil-spring assembly is necessarily relatively stiff and rugged. In GLOCK semi-automatic pistols, in order to field strip and/or fully disassemble the pistols, the slide is pulled slightly rearwards towards the receiver handgrip to allow the slide lock to be disengaged, thus allowing the slide to move forwards and off the receiver.

Once the slide has been removed from the receiver, the remainder of field strip of the slide parts of the GLOCK semi-automatic pistol is relatively straightforward. However, the initial steps of compressing the recoil-spring assembly with one hand while holding the slide with the other hand, same principal for removing of the barrel, may be challenging for a user or the like to initiate the field strip process of the GLOCK semi-automatic pistol without some way of holding the slide in place, for example by trying to balance the slide muzzle down on an uneven or flat surface.

When disassembly is needed to clean and/or replace the internal slide parts, one must remove the slide cover plate, while holding the slide with one hand and with the thumb on the cover plate pushing it outwards. Then the user must hold the pin punch tool with the other hand and insert the tool in between the firing pin's lug face and the inner backside of the spacer sleeve in order to depress the sleeve from the cover plate recess, while preventing parts under spring tension from jumping out. This disassembly process may be quiet challenging for many users. This disassembly process would be aided if the slide were placed in a block apparatus designed to receive the slide horizontally, without having to try to balance the slide vertically, muzzle down on an uneven or flat surface.

When disassembly is needed to clean and/or replace the firing pin assemble parts, the initial steps is inverting the firing pin assemble onto the rear of the slide, holding the slide in one hand while using thumb and forefinger to pull the firing pin spring downwards until free from the spring cups and with the other hand remove them. Then the user releases the spring upwards until no tension is present so that the spring may be removed, only then may the remaining firing pin and spacer sleeve be removed from the slide. Again, this process may be quick challenging for a user, without some way of holding just the firing pin assembly without use of the slide. For example, the user may try to balance the slide vertically, muzzle down on an uneven or flat surface and performing two different functions with one hand. It should be recognized that this disassembly process is similar for many semi-automatic slide type pistols, only the firing pin assembly receiving area of the apparatus of this disclosure would have to be conformed to the firing pin spacer sleeve and firing pin lug.

Disassembly of the GLOCK semi-automatic receiver is needed for cleaning and or replacement of worn and or damaged parts, the initial steps of removing the pins in a specific order (e.g., locking block pin, trigger pin, trigger mechanism housing pin) involves holding the receiver in one hand while using a pin punch tool to push out the locking block pin. The same process is used for the trigger mechanism housing pin, except the trigger pin removal requires one hand to perform two functions simultaneously, i.e., holding the receiver and moving the slide stop lever forwards/backwards, while the other hand pushes on the trigger pin with the pin punch tool. Again, these processes may be quiet challenging for a user, without some way of holding the receiver such as holding the receiver above a table top surface.

The remainder of the receiver disassembly is relatively straightforward. However, the receiver may be held by hand or placed on a standard bench block for maintenance and cleaning. Although placing the firearm on a bench block is more secure than holding the firearm with one hand, standard bench blocks have several drawbacks. For example, cylindrical bench blocks are small and limited in surface area to support a firearm sufficiently making for an unstable platform with limited usage, surface area, and safety issues. Often these types of bench blocks are restrictive in design, resulting in narrow usage and not intended for the complete maintenance and cleaning of the semi-automatic firearms. The rectangular type bench blocks are a more stable platform, but are also narrow in design and purpose. These blocks generally lack compartments for storage and organization of parts such as to separate small from large parts, nor support the slide horizontally for disassembly. Thus, these type of block provide insufficient platform area, limited of usage, limited surface area, and limited safety. The inventions of this disclosure provide block type cleaning apparatus that in their most basic form include a horizontal slide receiving area, a vertical slide receptacle, a cylindrical swivel receptacle and a swivel adapted to receive a pistol magazine. In other embodiments, the block apparatuses of this disclosure include a firing pin receptacle, a vertical slide receptacle, a second cylindrical receptacle, a large parts receptacle, and a small parts receptacle.

Embodiments of this disclosure broadly relate to methods for firearm maintenance, cleaning and servicing a semi-automatic pistol firearm comprising providing a bench block apparatus comprising a body including a firing pin assembly receptacle, a vertical slide receptacle, a first cylindrical receptacle, a horizontal slide receiving area including a reciprocating retention rod assembly having a retention rod, where the area is adapted to receive a slide of a firearm so that a gap is formed between a firing pin's lug face and an inner backside of a firing pin spacer sleeve of the slide allowing the retention rod to move upwards into the gap, a swivel assembly including a swivel body including a magazine receiving slot, and a shaft, and a support member including a shaft receiving channel adapted to receive the shaft so that the swivel assembly is rotatable about the shaft by 360°, where the support member is adapted to fit into the first cylindrical receptacle. The methods also include removing a slide from the firearm, placing the slide vertically in the vertical slide receptacle, removing a recoil spring assembly and a barrel from the slide, placing the slide horizontally in the horizontal slide receiving area, moving the slide until the retention rod pushes upward into the gap, and removing a slide cover plate, an extractor depressor plunger assembly, an extractor, a firing pin assembly, a firing pin safety, and a firing pin safety spring from the slide. The methods also include the steps of placing a receiver of the firearm having a magazine on the body of the apparatus and removing a locking block pin, a trigger pin, and a trigger housing pin from the receiver. The methods also include placing the swivel assembly into the first cylindrical receptacle, sliding the magazine into the magazine receiving slot of the swivel assembly, placing the receiver onto the magazine positioned on the swivel assembly, and removing a slide stop lever, a locking block, a trigger mechanism having an ejector, a slide lock, and a slide lock spring from the receiver. The methods also include placing the firing pin assembly in the firing pin assembly receptacle, and removing firing pin spring cups, a firing spring, a firing pin spacer sleeve, and a firing pin from a firing pin. In certain embodiments, the support member of the providing step further includes a narrow top portion including the shaft receiving channel, and a broader bottom portion adapted to fit into either the first cylindrical receptacle, and the reciprocating retention rod assembly of the providing step further includes the retention rod, a retention rod reciprocating member comprising a spring, a resilient and restorative member, or a combination thereof, a retention rod glide channel, and a rod spring channel, where the retention rod reciprocating member allows the retention rod to move up and down depending on a force applied to a top of the retention rod. In other embodiments, the reciprocating retention rod assembly of the providing step further includes a retention rod floor plate, and a retention rod floor plate channel, where the retention rod floor plate holds the retention rod reciprocating member and the retention rod in place, and the horizontal slide receiving area of the providing step further includes a first outer rail, a second outer rail, a first inner rail, a second inner rail, a third inner rail, a subcompact slide channel, a firing pin lug face stop channel, and a slide ramp channel, where the rails and the channels are adapted to conform to a bottom structure of the slide so that the retention rod is positioned to move upward into the gap facilitating the removal of a slide cover plate of the firearm, and the body of the providing step further includes a plurality of non-slip pads disposed on the bottom surface of the body or a plurality of legs including non-slip pads disposed on a bottom surface of each leg. In other embodiments, the body includes a second cylindrical receptacle, and at least one parts compartment adapted to receive components for the firearm during disassembly. In other embodiments, the body includes a small parts compartment, a large parts compartment, where the compartments are adapted to receive components for the firearm during disassembly, and a pin punch tool holder. In other embodiments, the methods further comprise placing the firearm components on in the compartment or the second cylindrical receptacle.

DETAILED DESCRIPTION OF DRAWING

Reference throughout this specification to one embodiment, an embodiment, or similar language means that a particular feature, structure, or characteristic described in the connection with the embodiment is included in at least one embodiment of the disclosure. Thus, appearances of the phrases in one embodiment, in an embodiment, and similar language throughout this disclosure may, but do not necessarily, all refer to the same embodiment.

Furthermore, the described features, structures, or characteristics of the disclosure may be combined in any suitable manner in one or more embodiments. In the following description, numerous specific details are provided to provide a thorough understanding of embodiments of the disclosure. One skilled in the relevant art will recognize, however, that the disclosure can be practiced without one or more of the specific details, or with other methods, components, materials, or operations are not shown or described in detail to avoid obscuring the aspects of the disclosure.

Referring now to FIGS. 1 and 3, a perspective view, enlarged section view, and an alternate view of an embodiment of the firearm bench block apparatus of this disclosure, generally 100, is shown to include a body 102 having a front edge 104, a rear edge 106, a left edge 108, a right edge 110, a top 112, a bottom 114, and a plurality of legs 116, where each leg 116 includes a non-slip pad 118. The body 102 also includes a firing pin assembly receptacle 120, a vertical slide receptacle 122, a small parts storage compartment 124, a large parts storage compartment 126, a first cylindrical receptacle 128, a second cylindrical receptacle 130, and a pin punch tool receptacle 132.

The apparatus 100 also includes a slide receiving area 140 shown in an enlarged sectional view in FIG. 1 and an exploded view in FIG. 4. The area 140 includes two outer rails 142*a* and 142*b*, three inner rails 144*a*, 144*b*, 144*c*, a subcompact slide channel 146, a firing pin lug face stop channel 148, and a slide ramp channel 150. The area 140 also includes a retention rod assembly 160, which includes a retention rod 162, a retention rod spring 164, a cylindrical retention rod channel or housing 166, a cylindrical retention rod spring channel or housing 168, a retention rod floor plate 170, and a retention rod floor plate channel or housing 172.

Figure 5A:
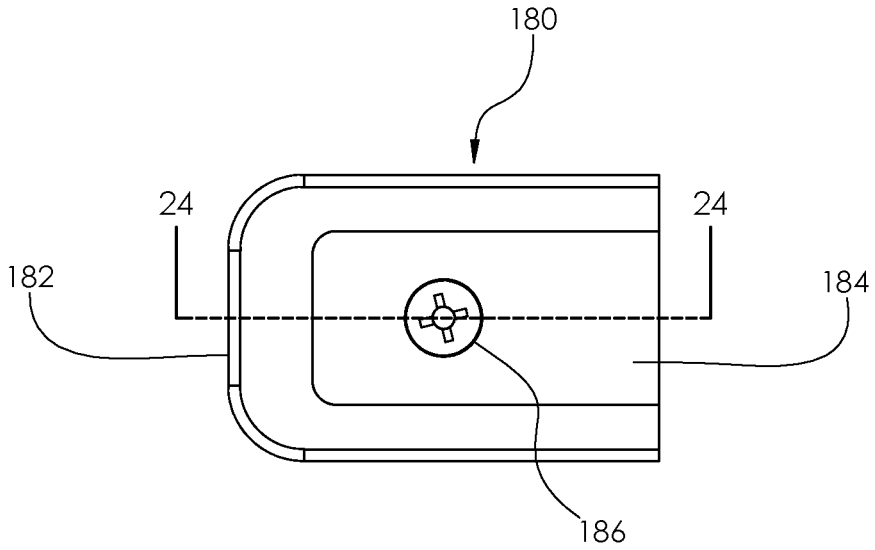
FIGS. 5A&B depicts a top plan view and a cross-sectional view of the swivel assembly of FIG. 1.
Figure 5B:
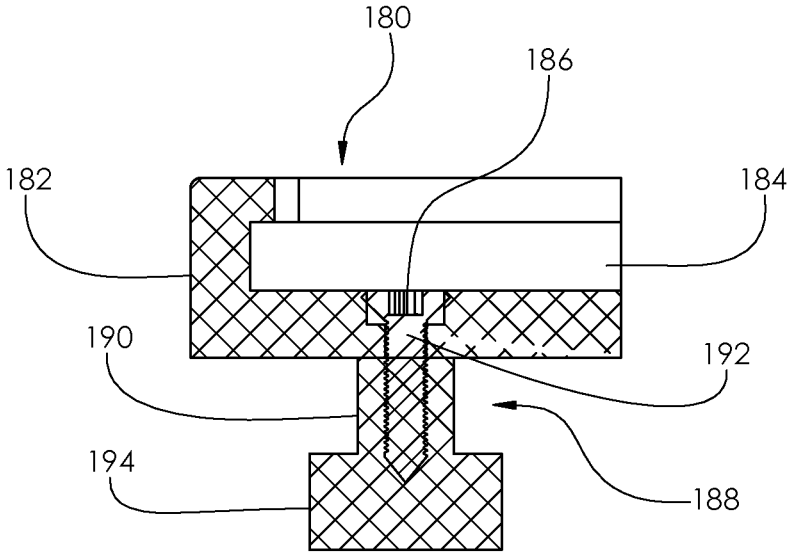

The apparatus 100 also includes a magazine holder and swivel assembly 180 as shown in FIG. 1 and FIGS. 5A&B. The assembly 180 includes a swivel body 182 having a magazine receiving slot 184 and a shaft 186. The assembly 180 also includes a cylindrical support member 188 having a narrow top portion 190 including a cylindrical shaft channel 192 and a broader bottom portion 194 adapted to be inserted into one of the cylindrical receptacles 128 and 130.

Figure 8:
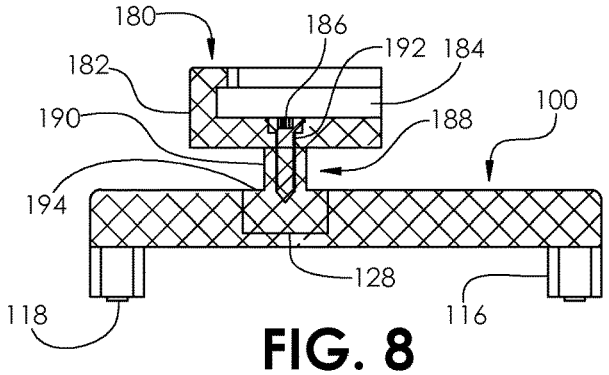
FIG. 8 depicts a front sectional view of another embodiment of the bench block along line 8-8 of FIG. 6.
Figure 6:
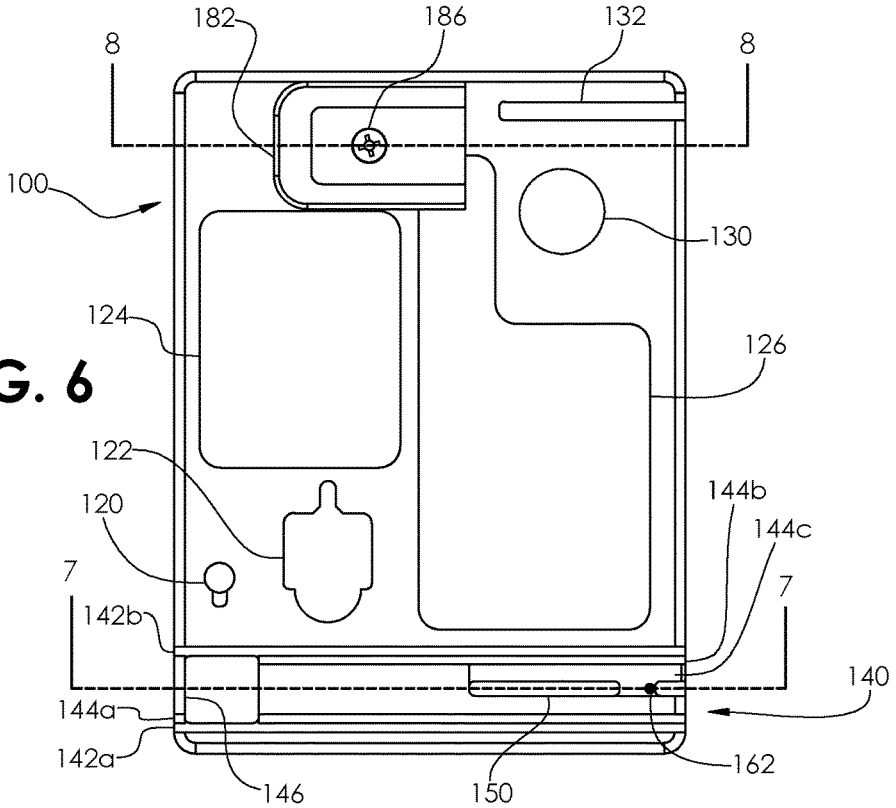
FIG. 6 depicts a top plan view thereof with the magazine holder and swivel attachment in place in accordance with an embodiment of the present disclosure of FIG. 1.
Figure 7:
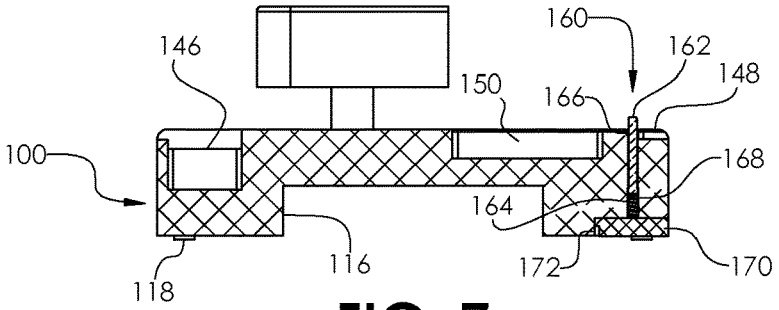
FIG. 7 depicts is a rear sectional view of another embodiment of the bench block along line 7-7 of FIG. 6.
Figure 9:
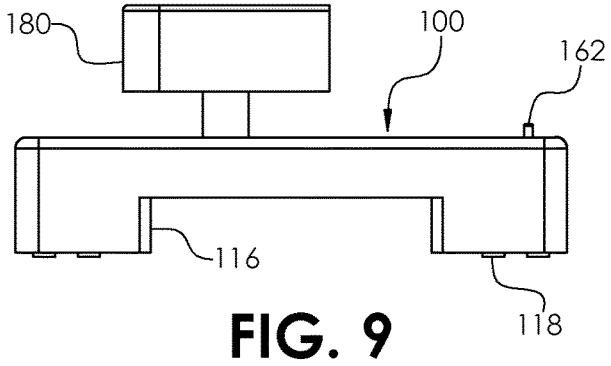
FIG. 9 depicts a rear elevation view thereof of FIG. 1.
Figure 10:
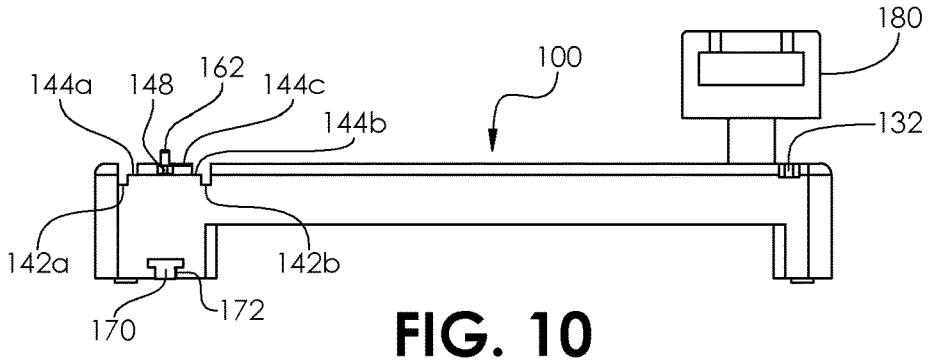
FIG. 10 depicts a right side elevation view thereof of FIG. 1.
Figure 11:
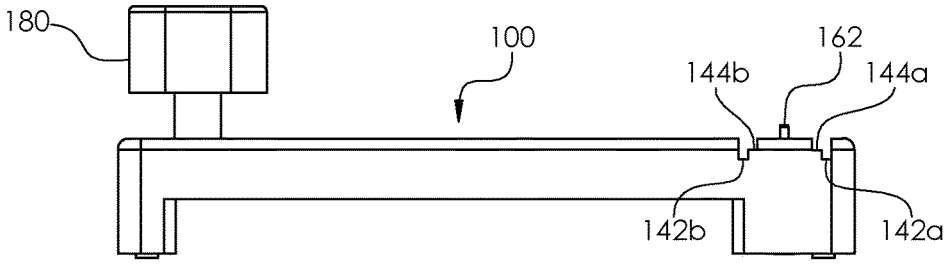
FIG. 11 depicts a left side elevation view thereof of FIG. 1.
Figure 12:
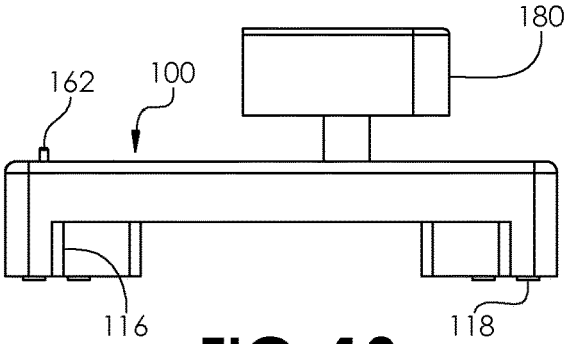
FIG. 12 depicts a front elevation view thereof of FIG. 1.

Referring now to FIG. 6 through FIG. 8, a plan view and two cross-sectional view through cutting lines 7 and 8 of the apparatus 100 are shown. Again, the apparatus 100 includes the elements set forth above. Looking at FIG. 7, a cross-section of the area 140 is shown. Looking at FIG. 8, a cross-section of the magazine holder and swivel assembly 180 is shown.

Referring now to FIG. 9 through FIG. 12, a front view, a right view, a left view and a rear view of the apparatus of FIG. 1 through FIG. 4 is shown.

Figure 13:
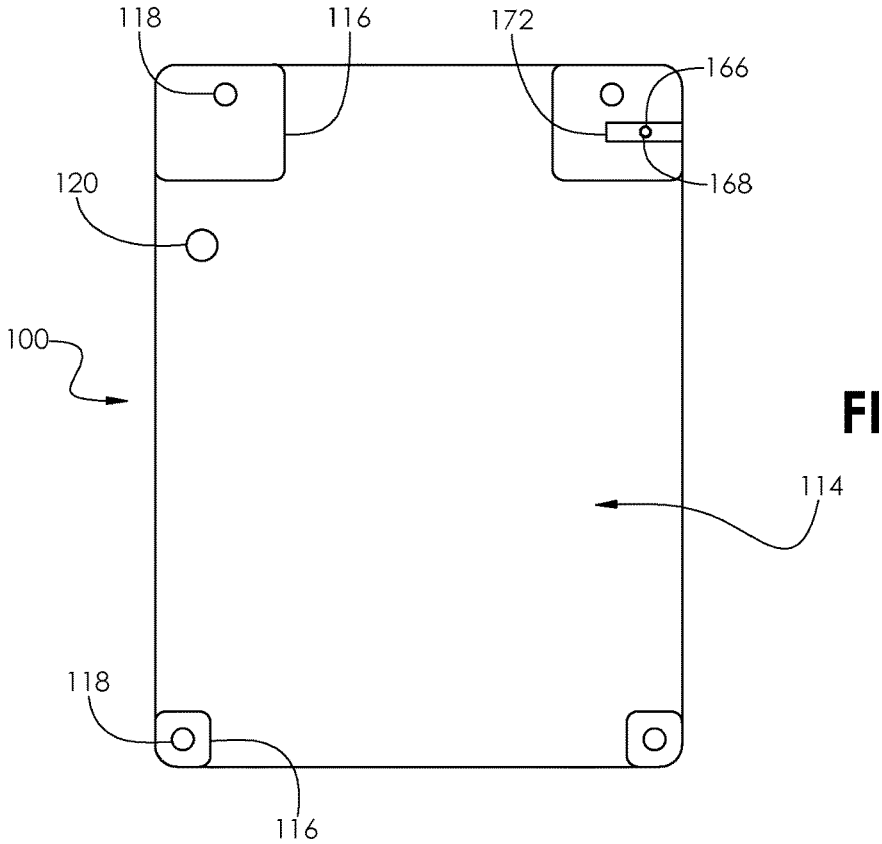
FIG. 13 depicts a bottom plan view thereof without the installed retention rod mechanism and floor plate of FIG. 1.
Figure 14:
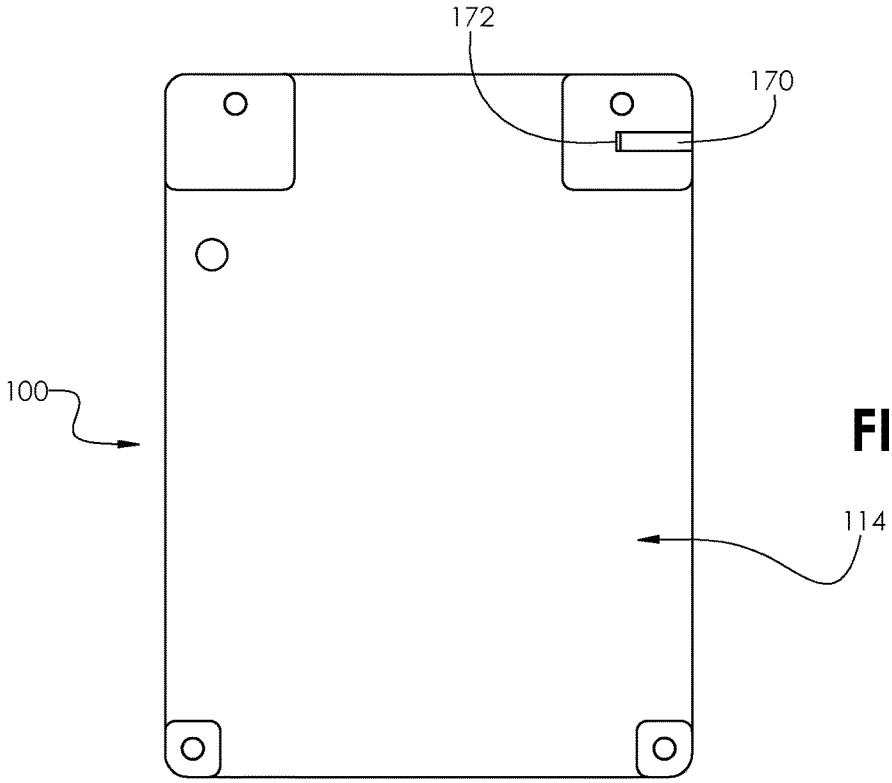
FIG. 14 depicts a bottom plan view thereof with installed retention rod mechanism and floor plate of FIG. 1.

Referring now to FIG. 13 through FIG. 14, bottom plan view of the apparatus of FIG. 1, without the retention rod assembly installed, FIG. 13, and with the retention rod assembly install, FIG. 14.

Figure 15A:
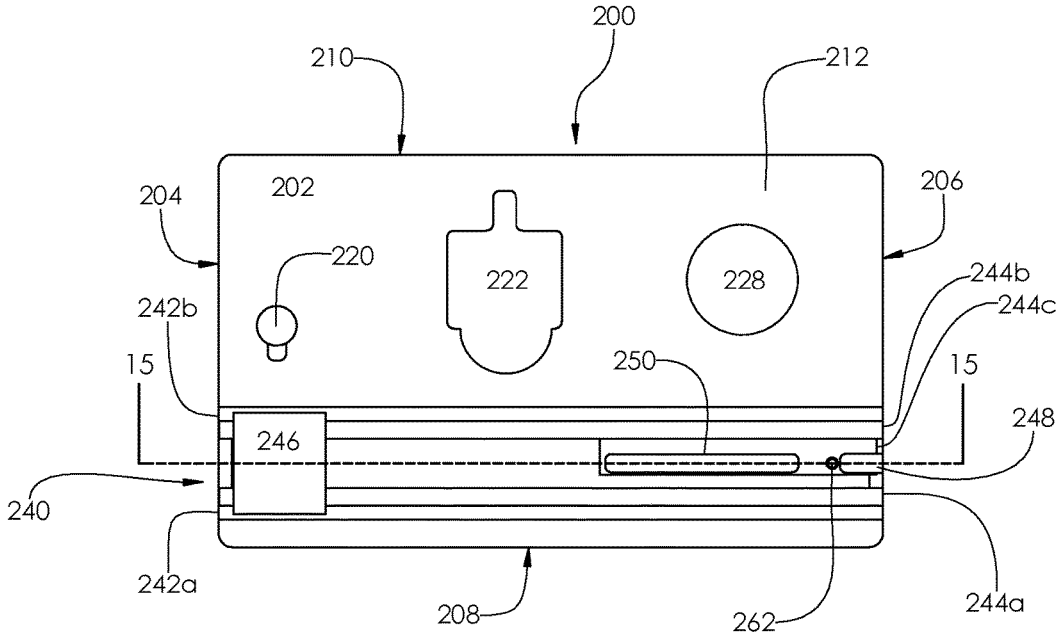
FIGS. 15A&B depict a top plan view and a cross-sectional view through line 15-15 of another embodiment of a bench block apparatus of the present disclosure.
Figure 15B:
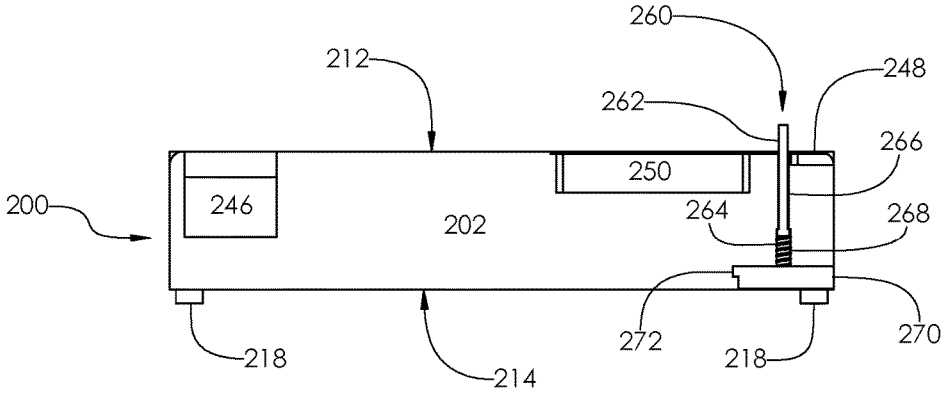

Referring now to FIGS. 15A&B, a top plan view and a cross-sectional view through cutting line 15 of an embodiment of the firearm bench block apparatus of this disclosure, generally 200, is shown to include a body 202 having a left edge 204, a right edge 206, a front edge 208, a rear edge 210, a top 212, a bottom 214, and a plurality non-slip pad 218. The body 202 also includes a firing pin assembly receptacle 220, a vertical slide receptacle 222, and a cylindrical receptacle 228. The apparatus 200 also includes a slide receiving area 240, which includes two outer rails 242*a* and 242*b*, three inner rails 244*a*, 244*b*, 244*c*, a subcompact slide channel 246, a firing pin lug face stop channel 248, and a slide ramp channel 250. The area 240 also includes a retention rod assembly 260, which includes a retention rod 262, a retention rod spring 264, a cylindrical retention rod channel or housing 266, a cylindrical retention rod spring channel or housing 268, a retention rod floor plate 270, and a retention rod floor plate channel or housing 272.

Figure 16A:
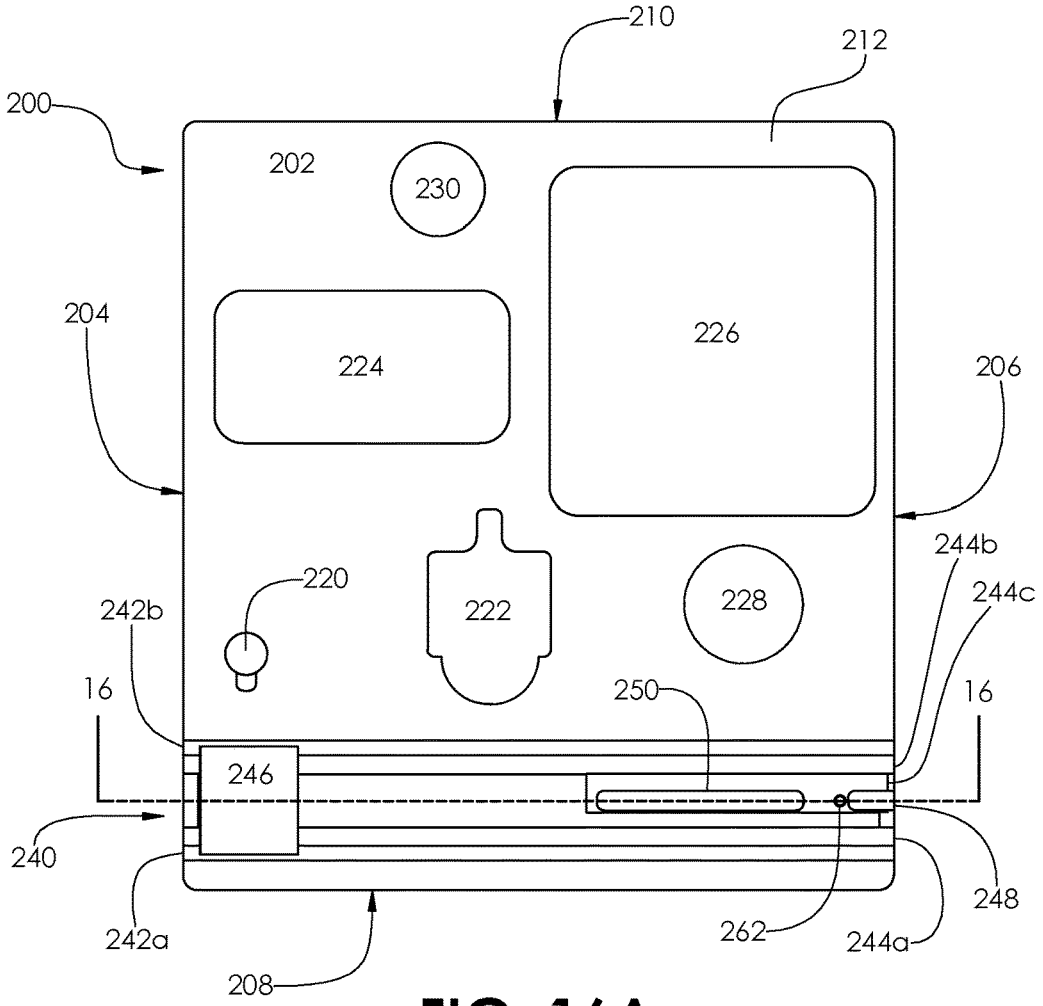
FIGS. 16A&B depict a top plan view and a cross-sectional view through line 16-16 of another embodiment of a bench block apparatus of the present disclosure.
Figure 16B:
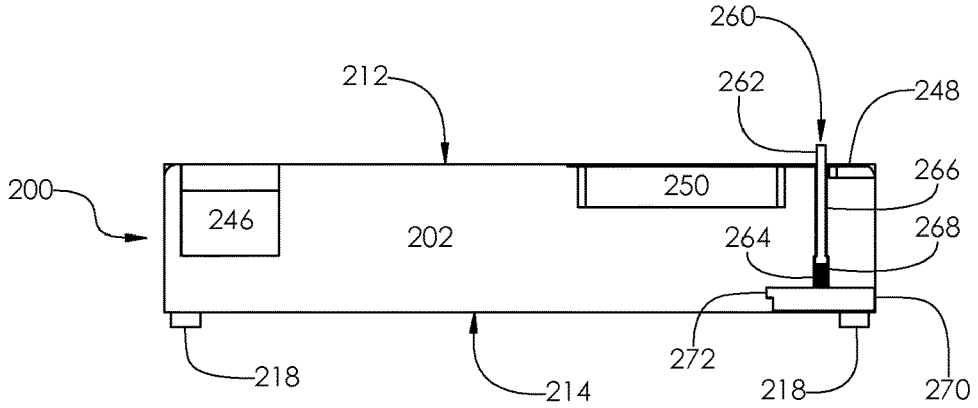

Referring now to FIGS. 16A&B, a top plan view and a cross-sectional view through cutting line 16 of an embodiment of the firearm bench block apparatus of this disclosure, generally 200, is shown to include a body 202 having a left edge 204, a right edge 206, a front edge 208, a rear edge 210, a top 212, a bottom 214, and a plurality non-slip pad 218. The body 202 also includes a firing pin assembly receptacle 220, a vertical slide receptacle 222, and a cylindrical receptacle 228. The apparatus 200 also includes a slide receiving area 240, which includes two outer rails 242*a* and 242*b*, three inner rails 244*a*, 244*b*, 244*c*, a subcompact slide channel 246, a firing pin lug face stop channel 248, and a slide ramp channel 250. The area 240 also includes a retention rod assembly 260, which includes a retention rod 262, a retention rod resilient restorative member 264, a cylindrical retention rod channel or housing 266, a cylindrical retention rod spring channel or housing 268, a retention rod floor plate 270, and a retention rod floor plate channel or housing 272. The member 264 may be made of any resilient and restorative material such as rubber, polyurethane rubber, silicone rubber, or any other type or resilient restorative material.

In certain embodiments, the body 202 also includes a small parts compartment 224. In other embodiments, the body 202 includes a large parts compartment 226. In other embodiments, the body 202 includes a cylindrical pin receiving receptacle 230. In other embodiments, the body 202 includes the two compartments 224 and 226. In other embodiments, the body 202 includes the compartment 224 and the receptacle 230. In other embodiments, the body 202 includes the compartment 226 and the receptacle 230. In other embodiments, the body 202 includes the compartments 224 and 226 and the receptacle 230.

Referring now to FIG. 17 through FIG. 23, different views of the apparatus of FIG. 1 through FIG. 14 are shown illustrating an embodiment of a method of this disclosure for dissembling, parts replacement, and cleaning of a handheld firearm.

Figure 17:
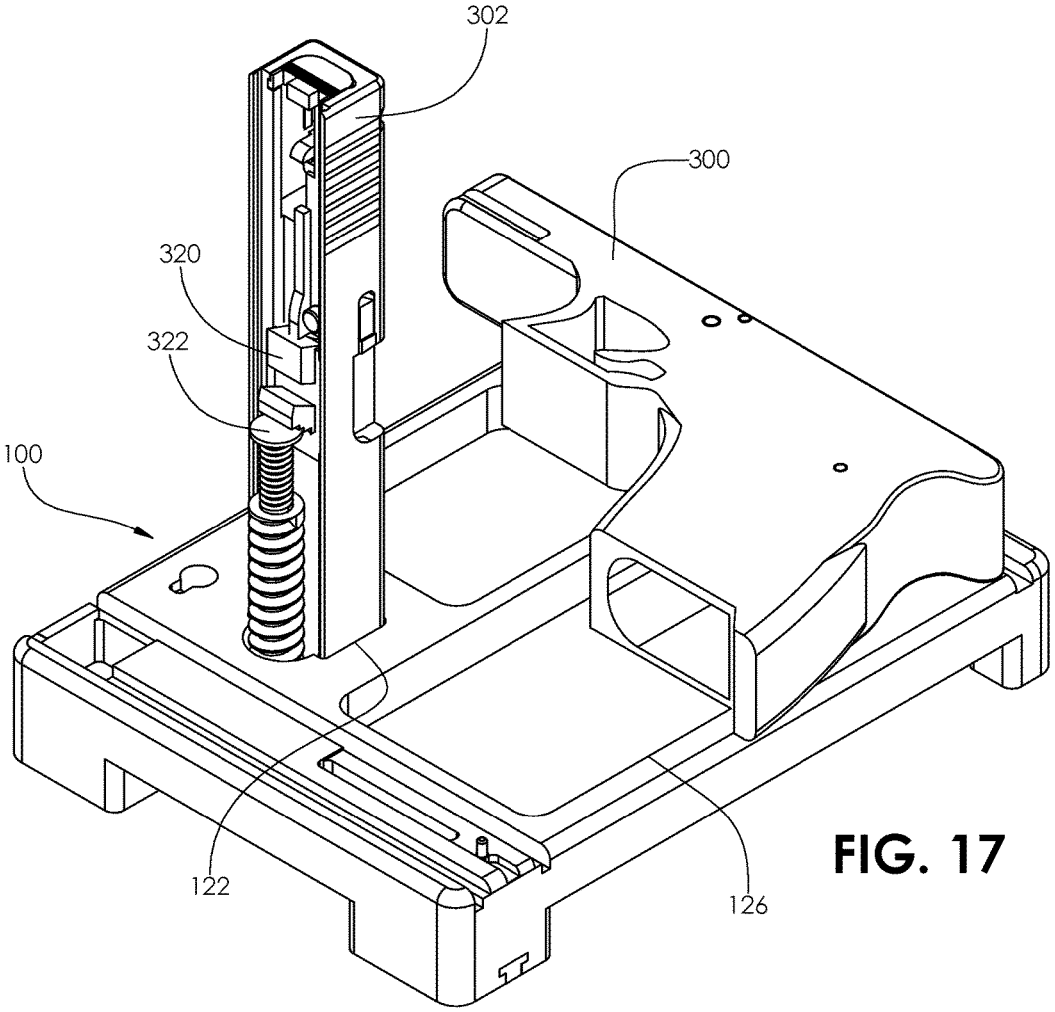
FIG. 17 depicts a perspective view that depicts the firearm slide vertically disposed in the vertical slide receptacle in accordance with an embodiment of the present disclosure of FIG. 1.

Looking at FIG. 17, a slide 302 of a handheld firearm is removed from a receiver 300 and placed vertically in the vertical slide receptacle 122. In this position, a recoil spring assembly 322 and a barrel 320 are removed from the slide 302. The recoil spring assembly 322 and the barrel 320 may be placed in the large compartment 126. The receiver 300 is placed horizontally onto the top 112 of the bench block 100 and oriented so that the pins are positioned over the cylindrical receptacles 128 and 130. Using a pin punch tool from the pin punch tool slot 132 and pushing downwards on each pin for removal. The pins may then be placed in the receptacle 130 or the compartment 124 for storage and reassembly.

Figure 18:
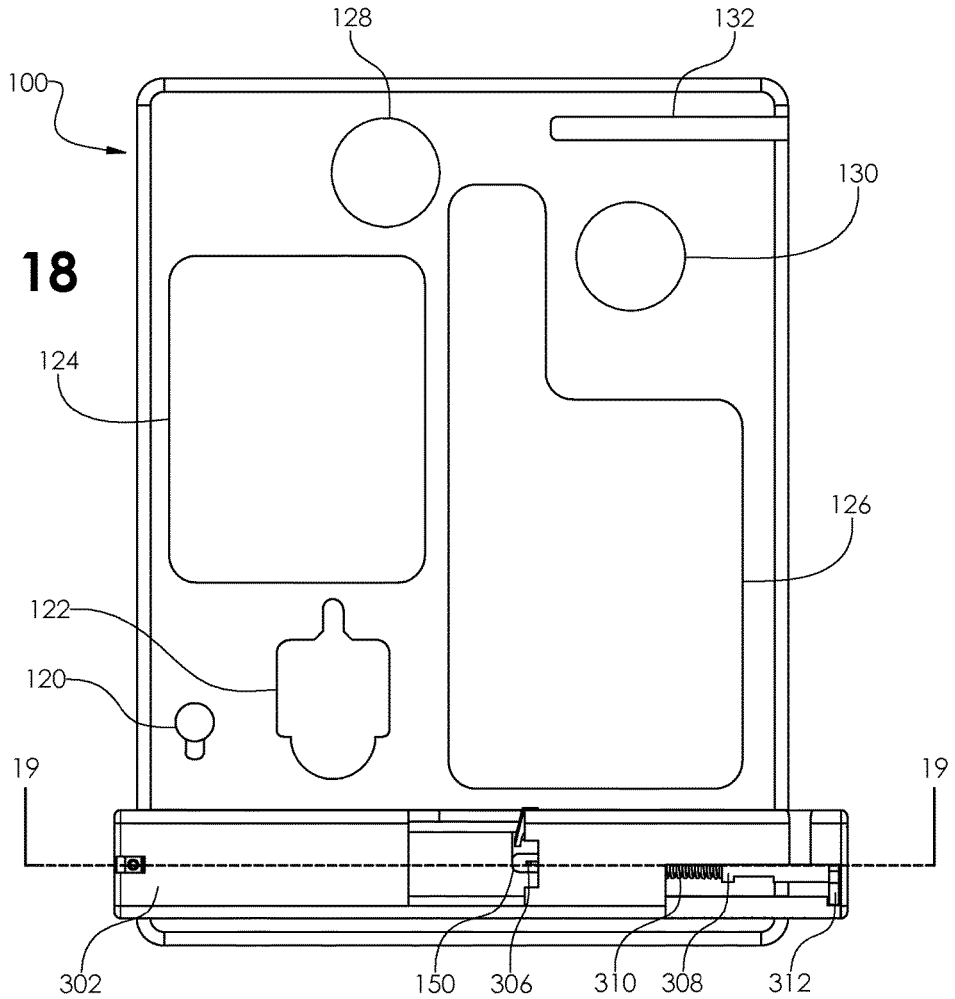
FIG. 18 depicts a top plan view that depicts the firearm slide disposed on the slide rail system and alignment in accordance with an embodiment of the present disclosure of FIG. 1.
Figure 19:
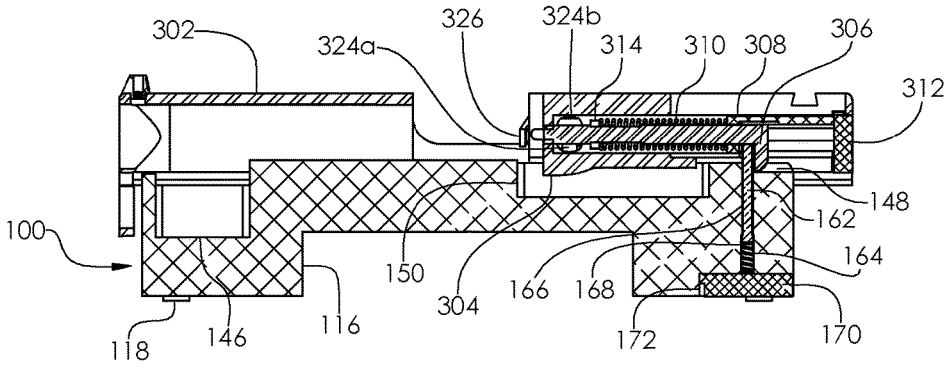
FIG. 19 depicts a rear sectional view of another embodiment of the bench block along line 19-19 of FIG. 18.

Looking at FIGS. 18 and 19, the firearm slide 302 is placed horizontally in the slide receiving area 140 so that the rails 142*a*, 142*b*, 144*a*, 144*b*, and 144*c* conform to bottom elements of the slide 302, with a muzzle of the slide 320 positioned to the left and a rear of the slide 320 positioned to the right as shown in FIGS. 18 and 19. The slide ramp 304 sits into the slide ramp channel 150. The firing pin's lug 306 sits into the firing pin's lug face stop channel 148. The bottom of the slide 302 contacts the retention rod 162. The underneath flat surfaces of the slide 302 press against the firing pin safety 324*a* pushing it upwards and the retention rod 162 downwards compressing both firing pin safety spring 324*b* and the retention rod spring 164 at the same time. Moving the slide 302 from right to left until the firing pin's lug face 306 contacts the end of the firing pin lug face stop channel 148 results in a gap between the firing pin's lug face 306 and the inner backside of the firing pin spacer sleeve 308 allowing the retention rod spring 164 to push the retention rod 162 upwards into the gap as shown in FIG. 19. Moving the slide 302 from left to right, while maintaining downwardly pressure, until the firing pin spring 310 has been compressed enough by the firing pin spacer sleeve 308 in conjunction with the retention rob 162 to unseat the firing pin spacer sleeve 308 from the recess channel located on the inside of the slide cover plate 312 so that it may be removed from the slide 302 and placed into the compartment 124 giving access to the internal parts. Maintaining the slide 302 in its current position, an extractor depressor plunger assembly (not shown) may be removed and placed into the compartment 124. An extractor 326 may then be removed and placed into compartment 124. Releasing the pressure from the retention rod 162 and firing pin spacer sleeve 308, lifting upwards on the rear of the slide 302 from the rail 142*a*, 142*b*, 144*a*, 144*b*, and 144*c*, and removing the retention rod 162 from the gap, the firing pin assembly 318 may be removed and placed into the compartment 124 for disassembly as described in FIG. 23. Lifting the slide 302 upwards until access to the firing pin safety 324*a* and firing pin safety spring 324*b* may be retrieved and the parts placed into the compartment 124.

Figure 21:
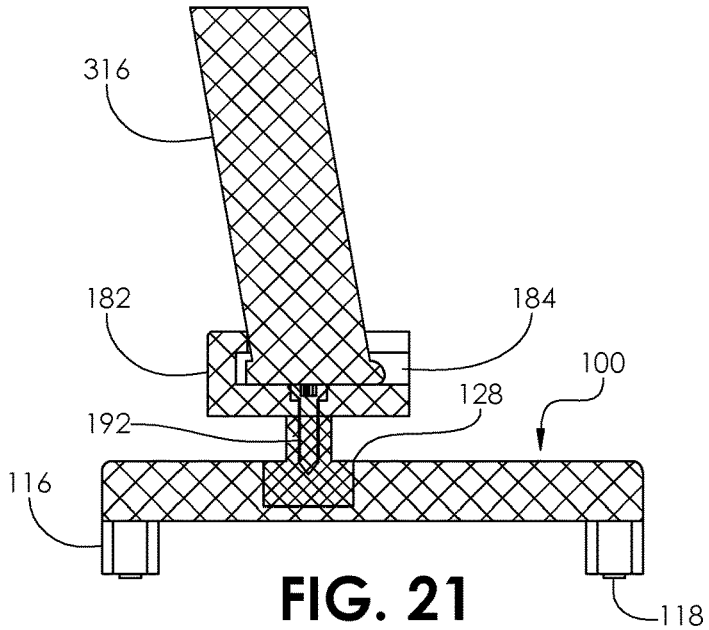
FIG. 21 depicts a front cross-sectional view of the bench block along line 21-21 of FIG. 20.
Figure 20:
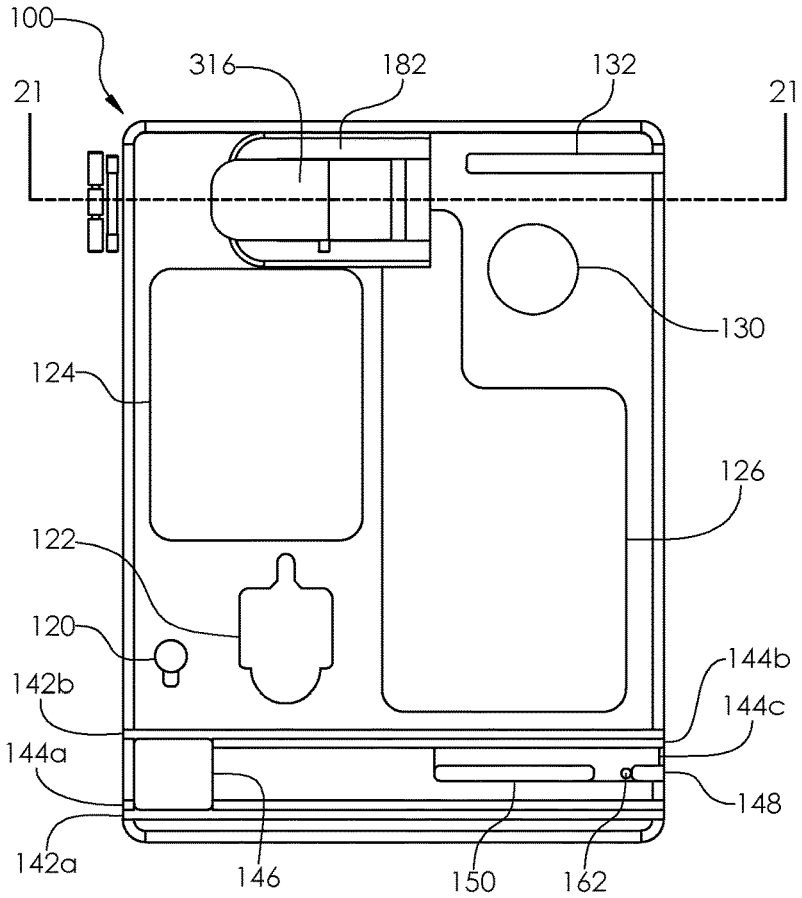
FIG. 20 depicts a top plan view that depicts the firearm magazine disposed into the magazine holder and swivel attachment in accordance with an embodiment of the present disclosure of FIG. 1.

Looking at FIG. 20 and FIG. 21, a magazine floor plate is then slid into the magazine slot 184 of the swivel assembly 180. Placing the cylindrical base or bottom portion 194 into either the cylindrical receptacle 128 or 130 as shown in FIG. 21. The receiver 300 may then be placed onto the magazine 316 allowing a 360 degree of rotation, giving various access options to a user, so that the receiver 300 may be easily disassemble of its internal parts (except for magazine catch and magazine catch spring) and the parts placed into the compartments 124 and 126 for storage and reassembly.

Figure 22:
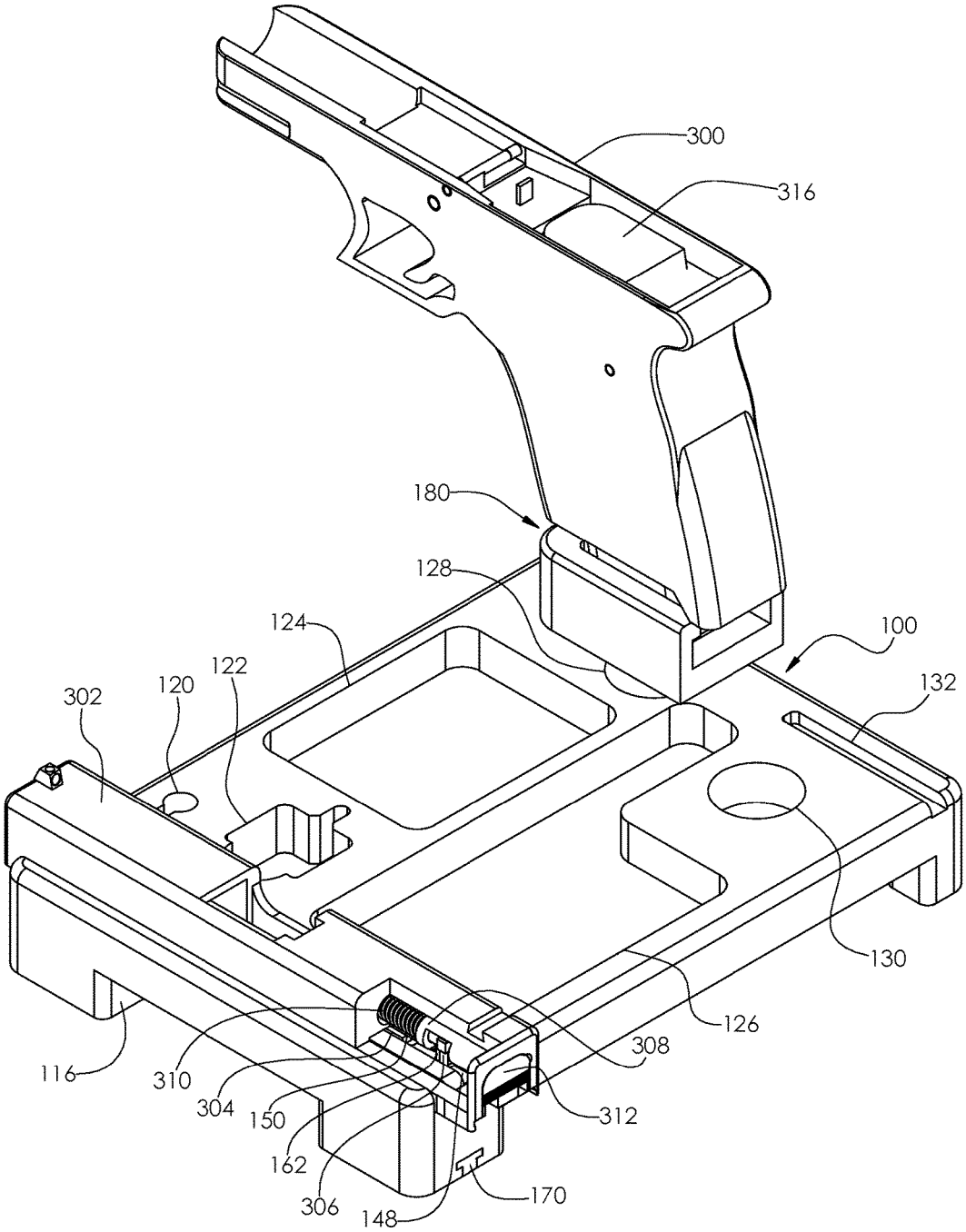
FIG. 22 depicts a perspective view of the apparatus of FIG. 1, showing a slide horizontally positioned in the horizontal slide receiving area and a magazine positioned in the swivel assembly.

Looking at FIG. 22, the apparatus 100 is shown with the slide 320 positioned into the slide receiving area 140 and the magazine 316, with the receiver 300, positioned in the swivel assembly 180.

Figure 23:
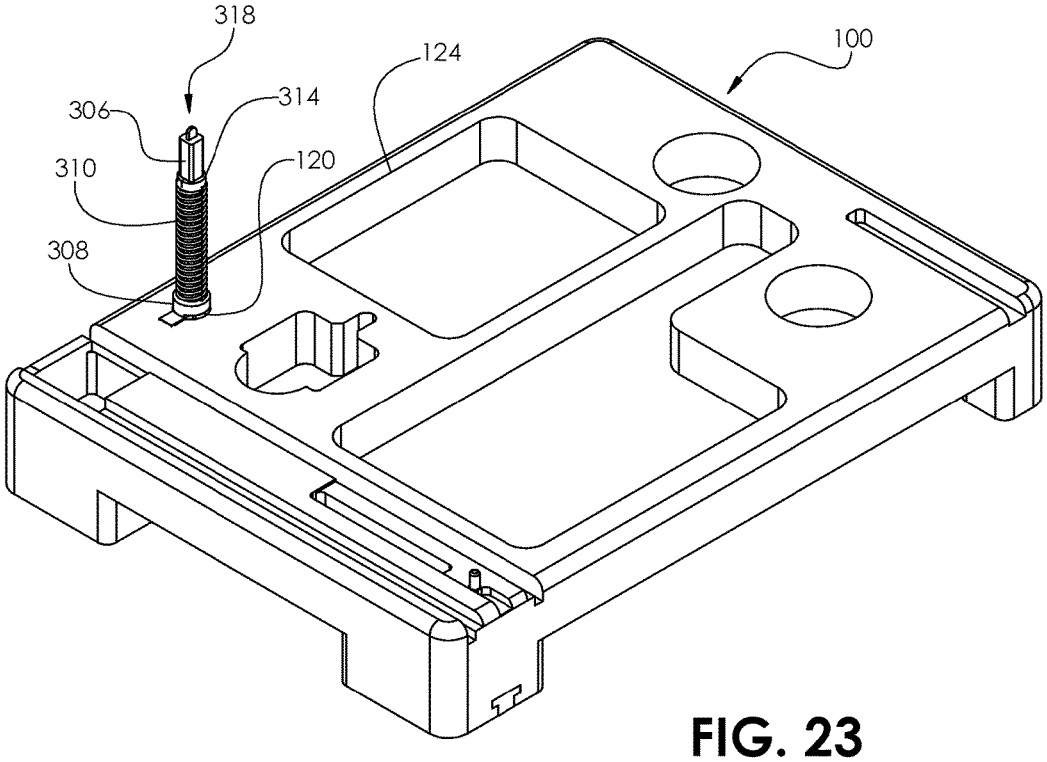
FIG. 23 depicts a perspective view that depicts the firearm firing pin assembly vertically disposed in the vertical firing pin assembly receptacle in accordance with the apparatus of FIG. 1.

Looking at FIG. 23, the firing pin assembly 318 may then be placed vertically into the firing pin assembly receptacle 120. Pulling the spring 310 downwards from the top, until the spring cups 314 may be removed and placed in the compartment 124 for reassembly or replacement. Slowly releasing the downward pressure on the firing pin spring 310, the spring 310 may be removed and placed in the compartment 124 for reassembly or replacement. Lifting the firing pin 316 with the spacer sleeve 308 from the receptacle 120, the spacer sleeve 308 may be removed from the firing pin 316, and the parts placed in the compartment 124 for storage and replacement or reassembly.

CLOSING

All references cited herein are incorporated by reference. Although the disclosure has been disclosed with reference to its preferred embodiments, from reading this description those of skill in the art may appreciate changes and modification that may be made which do not depart from the scope and spirit of the disclosure as described above and claimed hereafter. Consequently, it is intended that the claims be interpreted to cover such modifications and equivalents therein.

I claim:

1. A bench block apparatus comprising:

a body including:

a blind firing pin assembly receptacle comprising a cylindrical bore and a contiguous slot and recessed in a generally horizontal top surface of the body and configured to receive a firing pin assembly of a firearm so that the firing pin assembly will be disposed perpendicular to the top surface, a vertical slide receptacle recessed in the top surface of the body and configured to receive a firearm slide so that the slide will be disposed perpendicular to the top surface of the body, a first cylindrical receptacle recessed in the top surface of the body, a horizontal slide receiving area including:

a plurality of parallel outer rails recessed in the top surface of the body, a plurality of parallel inner rails recessed in the top surface of the body and disposed between and parallel to the outer rails, a firing pin lug face stop channel recessed in the top surface of the body and disposed between the outer rails, a slide ramp channel recessed in the top surface of the body and disposed between the outer rails, and a reciprocating retention rod assembly disposed between the outer rails and having:

a retention rod disposed vertically in the body and disposed in a retention rod glide channel, and a retention rod reciprocating member in contact with a distal end of the retention rod and disposed in a rod reciprocating member channel, wherein the rails and channels are configured to conform to a bottom structure of the slide and to form a gap between a firing pin lug face and an inner backside of a firing pin spacer sleeve of the slide, wherein the reciprocating member urges the retention rod vertically upwards into the gap so that the firing pin assembly of the slide may be removed, and wherein the retention rod reciprocating member comprises a spring, a resilient and restorative member, or a combination thereof; and a swivel assembly configured to be mounted in the first cylindrical receptacle and including:

a swivel body including:

a magazine receiving slot, and
a fastener, and
a support member including:
a narrow top body member,
an aperture disposed in the narrow top body member and configured to receive the fastener so that the swivel body is rotatable about the fastener by 360°, and
a cylindrical bottom body member configured to fit into the first cylindrical receptacle so that the magazine receiving slot extends horizontally above the top surface of the body.

2. The apparatus of claim 1, wherein the reciprocating retention rod assembly further includes:
a retention rod floor plate, and
a retention rod floor plate channel disposed in the bottom of the body and
configured to receive the retention rod floor plate,
wherein the retention rod floor plate is removable and a bottom of the retention rod reciprocating member rests on a top of the retention rod floor plate.

3. The apparatus of claim 1, wherein
the plurality of parallel outer rails include:
a first outer rail,
a second outer rail,
the plurality of parallel inner rails include:
a first inner rail,
a second inner rail,
a third inner rail,
the horizontal slide receiving area further includes:
a subcompact slide channel,
a firing pin lug face stop channel, and
a slide ramp channel,
wherein the rails and the channels are configured to conform to the bottom structure of the slide.

4. The apparatus of claim 1, wherein the body further includes:
a plurality of non-slip pads disposed on a bottom surface of the body, or
a plurality of legs including non-slip pads disposed on a bottom surface of each leg.

5. The apparatus of claim 1, wherein the body further includes:
a second cylindrical receptacle recessed in the top surface of the body, and
at least one parts compartment recessed in the top surface of the body,
wherein the second cylindrical receptacle is configured to receive the swivel assembly or components from the firearm during disassembly, and
wherein the at least one parts compartment is configured to receive components of the firearm during disassembly.

6. The apparatus of claim 5, wherein the body further includes:
a small parts compartment recessed in the top surface of the body and configured to receive small components of the firearm during disassembly,
a large parts compartment recessed in the top surface of the body and configured to receive large components of the firearm during disassembly, and
a channel recessed in the top surface of the body at a top edge of the body and configured to receive a pin punch tool.

7. A bench block apparatus comprising:
a body including:
a blind firing pin assembly receptacle having a generally cylindrical shape including a contiguous slot and recessed in a generally horizontal top surface of the body and configured to receive a firing pin assembly of a firearm so that the firing pin assembly will be disposed perpendicular to the top surface,
a vertical slide receptacle recessed in the top surface of the body and configured to receive a slide of the firearm so that the slide will be disposed perpendicular to the top surface of the body,
a first cylindrical receptacle recessed in the top surface of the body,
a horizontal slide receiving area including:
a first outer rail recessed in the top surface of the body,
a second outer rail recessed in the top surface of the body,
a plurality of inner rails disposed between the first outer rail and the second outer rail and comprising:
a first inner rail recessed in the top surface of the body,
a second inner rail recessed in the top surface of the body,
a third inner rail recessed in the top surface of the body, a subcompact slide channel recessed in the top surface of the body and disposed between the first outer rail and the second outer rail,
a firing pin lug face stop channel recessed in the top surface of the body and disposed between the first outer rail and the second outer rail, and
a slide ramp channel recessed in the top surface of the body and disposed between the first outer rail and the second outer rail,
wherein all of the outer rails and all of the inner rails are parallel,
wherein the rails and channels are configured to conform to a bottom structure of the slide of the firearm,
a reciprocating retention rod assembly disposed between the outer rails and comprising:
a retention rod channel disposed vertically within the body,
a retention rod disposed within the retention rod channel,
a retention rod reciprocating member channel disposed vertically within the body at a bottom of the retention rod channel,
a retention rod reciprocating member disposed within the reciprocating member channel,
a retention rod floor plate channel disposed in a bottom of the body, and
a retention rod floor plate disposed within the retention rod floor plate channel,
wherein the retention rod reciprocating member is compressed when the slide is pushed into the horizontal slide receiving area to urge the retention rod vertically upwards into a gap formed between
a firing pin lug face and an inner backside of a firing pin spacer sleeve of
the slide facilitating removal of a firing pin spacer sleeve from the slide, and
a swivel assembly configured to be mounted in the first cylindrical receptacle and including:
a swivel body including:
a magazine receiving slot, and a fastener, and a support member including:

a narrow top body member including:

an aperture disposed in the narrow top body member and configured to receive the fastener so that the swivel body is rotatable about the fastener by 360°, and a broader bottom body member configured to fit into the first cylindrical receptacle so that the magazine receiving slot extends horizontally above the top surface of the body.

8. The apparatus of claim 7, wherein the body further includes:

a plurality of non-slip pads disposed on a bottom surface of the body, or a plurality of legs including non-slip pads disposed on a bottom surface of each leg, or a second cylindrical receptacle recessed in the top surface of the body and configured to receive the bottom portion of the swivel assembly or components from the firearm during disassembly, or at least one parts compartment recessed in the top surface of the body and configured to receive components of the firearm during disassembly, or any combination thereof.

9. The apparatus of claim 8, wherein the body further includes:

a small parts compartment recessed in the top surface of the body and configured to receive small components of the firearm during disassembly, a large parts compartment recessed in the top surface of the body and configured to receive large components of the firearm during disassembly, and a channel recessed in the top surface of the body at a top edge of the body and configured to receive a pin punch tool.

10. A bench block apparatus comprising:

a body including:

a top defining a generally horizontal top surface, a bottom defining a generally horizontal bottom surface, a blind firing pin assembly receptacle comprising a cylindrical bore and a contiguous slot and recessed in the generally horizontal top surface of the body and configured to receive a firing pin assembly of a firearm so that the firing pin assembly will be disposed perpendicular to the top surface, a horizontal slide receiving area including:

a first outer rail recessed in the top surface of the body, a second outer rail recessed in the top surface of the body, wherein the first and second outer rails are parallel to each other, a plurality of parallel inner rails recessed in the top surface of the body and parallel to and disposed between the outer rails and comprising:

a first inner rail, a second inner rail, and a third inner rail, a firing pin lug face stop channel recessed in the top surface of the body and disposed between the outer rails, and a slide ramp channel recessed in the top surface of the body and disposed between the outer rails, wherein the rails and channels are configured to conform to a bottom structure of a slide of the firearm, a reciprocating retention rod assembly comprising:

a retention rod channel disposed vertically within the body, a retention rod disposed within the retention rod channel, a retention rod reciprocating member channel disposed vertically within the body at a bottom of the retention rod channel, a retention rod reciprocating member disposed within the reciprocating member channel, a retention rod floor plate channel disposed in the bottom of the body, and a retention rod floor plate disposed within the retention rod floor plate channel, wherein the retention rod is pushed downwards compressing the retention rod reciprocating member when the slide is inserted into the horizontal slide receiving area so that the compressed retention rod reciprocating member urges the retention rod upwards into a gap formed between a firing pin lug face and an inner backside of a firing pin spacer sleeve of the slide facilitating removal of a firing pin spacer sleeve from the slide.

11. The apparatus of claim 10, wherein the body further includes:

a subcompact slide channel recessed in the top surface of the body and disposed between the outer rails so that the horizontal slide receiving area conforms to a bottom surface of a subcompact handheld firearm slide.

* * * * *